US008668633B2

(12) United States Patent
Ho

(10) Patent No.: US 8,668,633 B2
(45) Date of Patent: Mar. 11, 2014

(54) WAIST AND HIP DEVELOPER

(76) Inventor: Wei-Teh Ho, Taipei (TW)

( * ) Notice: Subject to any disclaimer, the term of this patent is extended or adjusted under 35 U.S.C. 154(b) by 172 days.

(21) Appl. No.: 13/065,072

(22) Filed: Mar. 14, 2011

(65) Prior Publication Data

US 2012/0238419 A1 Sep. 20, 2012

(51) Int. Cl.
*A63B 21/00* (2006.01)

(52) U.S. Cl.
USPC ..... 482/131; 482/71; 482/142

(58) Field of Classification Search
USPC ..... 482/72, 51, 52, 70, 97; 297/271.6, 297/258.1, 325
See application file for complete search history.

(56) References Cited

U.S. PATENT DOCUMENTS 1,979,716 A * 11/1934 Terry ..... 482/72
4,705,268 A * 11/1987 Nadeau ..... 482/72
5,192,258 A * 3/1993 Keller ..... 482/71
5,328,427 A * 7/1994 Sleamaker ..... 482/71
5,374,228 A * 12/1994 Buisman et al. ..... 482/71
7,935,032 B1 * 5/2011 Jackson ..... 482/70
7,951,056 B2 * 5/2011 Radzwill ..... 482/142
8,113,997 B2 * 2/2012 Fernandez et al. ..... 482/71

* cited by examiner

*Primary Examiner* — Jerome w Donnelly
(74) *Attorney, Agent, or Firm* — Jackson IPG PLLC

(57) ABSTRACT

A waist and hip developer includes a track curving smoothly upwardly toward two distal ends thereof and having two stop members respectively located at two distal ends thereof, foot members affixed to the track for supporting the track on the floor steadily, a slide slidably coupled to the track with rollers thereof and movable back and forth along the track between the stop members, a seat rotatably supported on the slide with a ball bearing, two grips respectively affixed to the two distal ends of the track, and a counter for counting of the number of reciprocating cycles of the slide moving by the user sitting on the seat.

1 Claim, 3 Drawing Sheets

WAIST AND HIP DEVELOPER

BACKGROUND OF THE INVENTION

1. Field of the Invention

The present invention relates to exercising machines and more particularly, to a waist and hip developer, which comprises a track curving smoothly upwardly toward two distal ends thereof and having two stop members respectively located at two distal ends thereof, foot members affixed to the track for supporting the track on the floor steadily, a slide slidably coupled to the track with rollers thereof and movable back and forth along the track between the stop members, a seat rotatably supported on the slide with a ball bearing, and two grips respectively affixed to the two distal ends of the track.

2. Description of the Related Art

Due to unbalanced diet, many people get too many refined and processed carbohydrates. Further, due to lack in exercise places, most people do not take adequate amount of exercise daily. Because modern people do more care about the body health, many exercise machines are created and have appeared on the market. However, few commercial exercising machines have the function for training the muscles of the waist and hips. There are multipurpose gymnastic machines having such a function. However, these machines are commonly expensive and heavy.

SUMMARY OF THE INVENTION

The present invention has been accomplished under the circumstances in view. It is one object of the present invention to provide a waist and hip developing exercisers, which is practical for training the muscles of the waist and hips. It is another object of the present invention to provide a waist and hip developing exercisers, which is inexpensive and not heavy.

To achieve these and other objects of the present invention, a waist and hip developer comprises a track curving smoothly upwardly toward two distal ends thereof and having two stop members respectively located at two distal ends thereof, foot members affixed to the track for supporting the track on the floor steadily, a slide slidably coupled to the track with rollers thereof and movable back and forth along the track between the stop members, a seat rotatably supported on the slide with a ball bearing, two grips respectively affixed to the two distal ends of the track, and a counter for counting of the number of reciprocating cycles of the slide moving by the user sitting on the seat. When using the waist and hip developer, the user can sit on the seat and then twist the waist to rotate the seat relative to the slide and simultaneously to move the seat and the slide alternatively leftwards and rightwards along the track between the stop members. By means of repeating the aforesaid procedure, the muscles of the user's waist and hips are trained.

DETAILED DESCRIPTION OF THE PREFERRED EMBODIMENT

Figure 1:
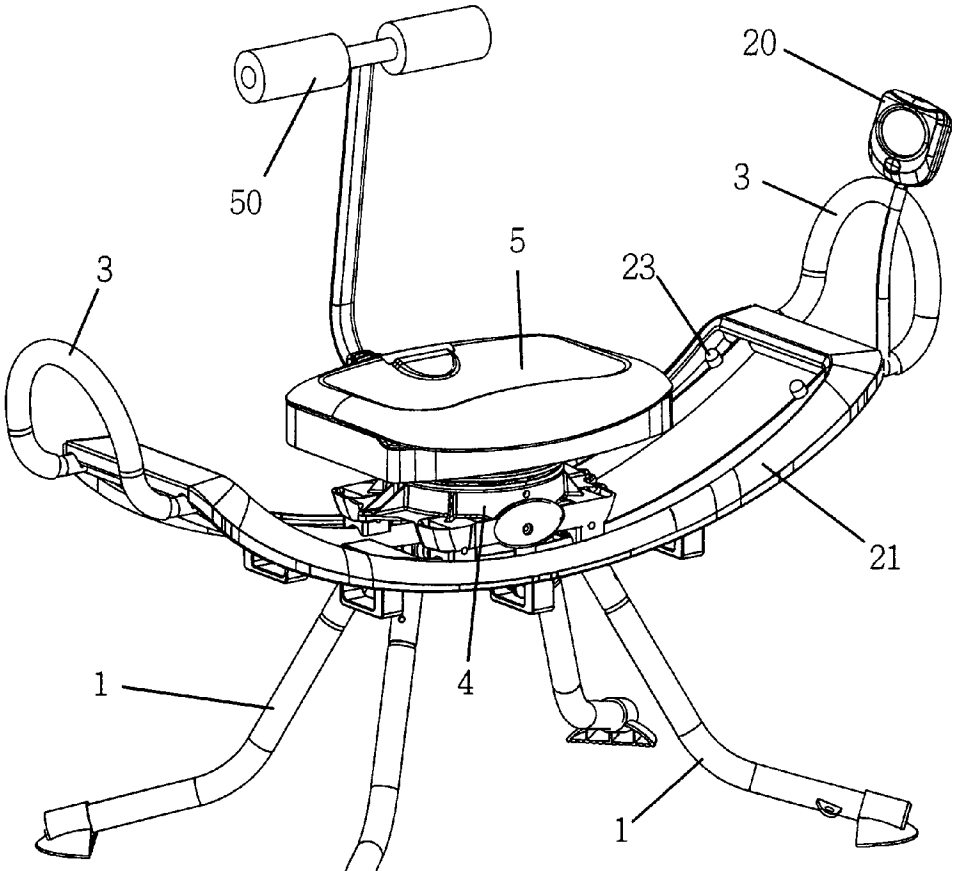
FIG. 1 is an elevational view of a waist and hip developer in accordance with the present invention.
Figure 2:
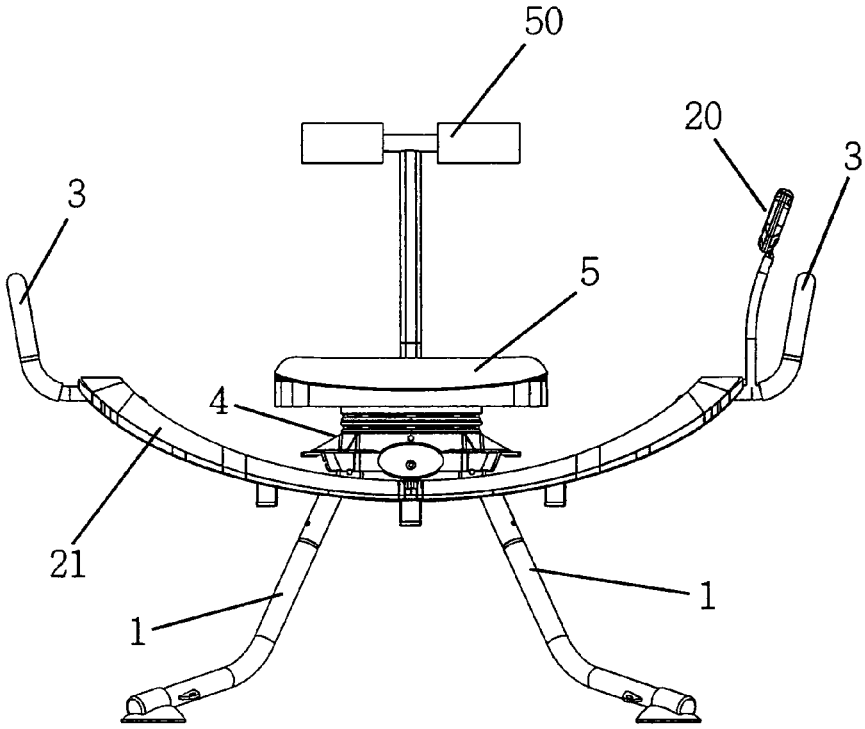
FIG. 2 is a front view of the waist and hip developer in accordance with the present invention.
Figure 3:
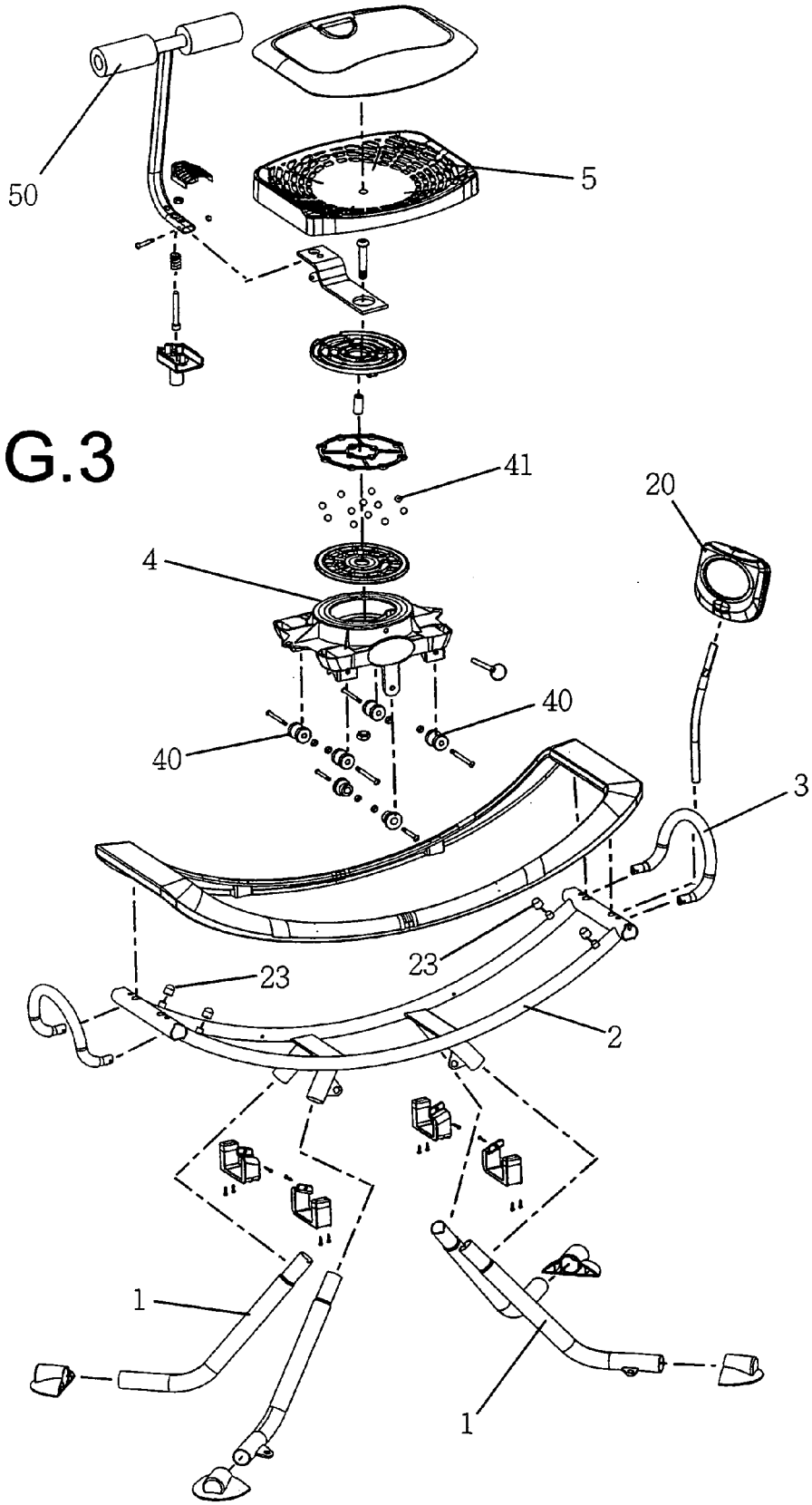
FIG. 3 is an exploded view of the waist and hip developer in accordance with the present invention.

Referring to FIGS. 1~3, a waist and hip developer in accordance with the present invention is shown comprising a plurality of foot members 1, a track 2, a grip 3, a slide 4 and a seat 5.

The track 2 is smoothly arched and curving upwardly toward two distal ends thereof, having stop members 23 respectively located near the two distal ends. The foot members 1 are affixed to the bottom side of the track 2 and adapted for supporting the track 2 on the floor steadily. The slide 4 is slidably coupled to the track 2 with rollers 30 and movable back and forth along the track 2 between the stop members 23 at the two distal ends of the track 2. The seat 5 is supported on the slide 4 with a ball bearing 41 and rotatable relative to the slide 4 within a predetermined angle. The grips 3 are respectively affixed to the two distal ends of the track 2 at the top side. Further, a counter 20 is mounted on one end of the track 2. Further, a guard 21 is mounted around the border of the track 2 for protection and decoration. Further, a backrest 50 is affixed to the seat 5 for supporting the back of the user sitting on the seat 5.

When using the waist and hip developer, the user can position the waist and hip developer on the floor by means of the foot members 1, and then sit on the seat 5 and hold the grips 3 with the two hands, and then twist the waist to rotate the seat 5 relative to the slide 4 and simultaneously to move the seat 5 and the slide 4 alternatively leftwards and rightwards along the track 2 between the stop members 23 at the two distal ends of the track 2. By means of repeating the aforesaid procedure, the muscles of the user's waist and hips are trained. During exercise, the user can rest the back of the body on the backrest 50. At the same time, the counter 20 counts the number of reciprocating cycles of the exercise and length of the exercising time.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A waist and hip developer, comprising:

a track being smoothly arched and curving upwardly toward two distal ends thereof, said track comprising two stop members respectively located near the two distal ends thereof;

a plurality of foot members affixed to a bottom side of said track and adapted for supporting said track on the floor steadily;

a slide slidably coupled to said track with rollers thereof and movable back and forth along said track between said stop members; and a seat supported on said slide with a ball bearing, wherein said seat comprises a backrest for supporting the back of a person sitting on said seat.

* * * * *